US007624744B2

(12) United States Patent
Wallace

(10) Patent No.: US 7,624,744 B2
(45) **Date of Patent: *Dec. 1, 2009**

(54) PAINT ROLLER TOOL

(76) Inventor: Millard F. Wallace, 555 Ridge Rd., Orwigsburg, PA (US) 17961

( * ) Notice: Subject to any disclaimer, the term of this patent is extended or adjusted under 35 U.S.C. 154(b) by 543 days.

This patent is subject to a terminal disclaimer.

(21) Appl. No.: 11/442,819

(22) Filed: May 30, 2006

(65) Prior Publication Data

US 2006/0272683 A1 Dec. 7, 2006

Related U.S. Application Data

(60) Provisional application No. 60/686,717, filed on Jun. 2, 2005.

(51) Int. Cl.
*B08B 3/00* (2006.01)
*B08B 3/12* (2006.01)

(52) U.S. Cl. ..... 134/138; 134/139; 134/140; 134/149; 134/183; 134/198; 134/199

(58) Field of Classification Search ..... 134/138, 134/139, 140, 149, 183, 198, 199
See application file for complete search history.

(56) References Cited

U.S. PATENT DOCUMENTS 3,730,195 A 5/1973 Kay
4,011,622 A 3/1977 Gillum et al.
4,108,189 A 8/1978 Claiborne et al.
4,667,363 A 5/1987 Calvert
4,700,728 A 10/1987 Patterson
4,765,353 A 8/1988 Rhoades
5,095,928 A 3/1992 Phipps
5,238,012 A * 8/1993 Coronato ..... 134/140
5,363,869 A 11/1994 McDowell
5,614,021 A 3/1997 Caitlin
5,839,459 A 11/1998 Bisby
6,019,111 A * 2/2000 Gillies ..... 134/138
6,450,185 B1 * 9/2002 Sallinen ..... 134/138
7,325,557 B2 * 2/2008 Wallace, III ..... 134/38
2004/0231086 A1 * 11/2004 Watkins ..... 15/236.06

* cited by examiner

*Primary Examiner*—Michael Barr
*Assistant Examiner*—Rita R Patel
(74) *Attorney, Agent, or Firm*—MacCord Mason PLLC

(57) ABSTRACT

An apparatus for covering and cleaning a cylindrical paint roller pad includes a painting shield having a semi-cylindrical side wall; mounting means for rotatably mounting the pad so that the painting shield side wall is spaced from a first segment of the pad side wall with the longitudinal axis of the pad is coincident with the axis of curvature of the painting shield side wall; a rinse shield rotatable between a closed position substantially beneath the painting shield side wall and an extended position spaced from a second segment of the roller outer surface, the shields being spaced to form a water discharge gap when the rinse shield is in its extended position; and a water manifold to direct water against the pad. The mounting means may be a spindle with a secured handle, or a separate handle attachable to the painting shield.

17 Claims, 7 Drawing Sheets

PAINT ROLLER TOOL

This application claims the benefit of the filing date of Provisional Application Ser. No. 60/686,717, filed Jun. 2, 2005.

BACKGROUND OF THE INVENTION (1) Field of the Invention

The present invention relates to a paint roller cover for preventing splatter from a cylindrical paint roller pad during painting and for subsequently cleaning paint from paint roller pads, and in particular to a paint roller cover that can remain attached to a paint roller pad during use and cleaning.

(2) Description of the Prior Art

Paint is commonly applied to large surfaces, such as walls, with a cylindrical paint roller pad that is coated with paint and then rolled over the surface to be painted. Normally, the pad will be carried on a spindle rotatably mounted on a handle. Heretofore, removal of paint, especially latex paint, from paint roller pads has usually been performed by placing the roller pad under a faucet and massaging the pad with the fingers. This procedure, in addition to being messy and time consuming, normally leaves some of the paint in the pad. Devices have been purposed in which the pad is placed in housing and cleaned by pumping water through the housing. Designs so far purposed have met with little commercial acceptance.

Thus, there is a need for a simple, mess-free, efficient and economical device for cleaning paint from paint roller pads, and particularly a device that will also prevent splattering of paint during painting. In addition, there is a need for a quick clean-up paint roller splatter cover that can be compactly stored and displayed for retail sale.

SUMMARY OF THE INVENTION

This need is addressed by the present invention, which is comprised of a quick clean-up paint roller cover that is attachable to a source of water, such as a faucet or spigot. The cover is designed as a "universal" cover, i.e., a cover that can be attached to most commercially available paint roller spindles. The quick clean-up paint roller cover is generally comprised of a painting splatter shield to prevent splatter of paint from the pad and catch paint drips during painting, a rinse splatter shield operable in combination with the painting splatter shield to partially cover the roller pad during cleaning, and a water source, i.e., a manifold, to tangentially spray water against a pad supported within the painting splatter and rinse splatter shields to rinse and spin clean the paint roller pad.

Preferably, the shields are molded of a transparent plastic so that the interior of the cover can be viewed during painting and cleaning. The painting splatter shield is preferably integrally molded with the manifold.

More specifically, the painting splatter shield of the invention is comprised of a semi-cylindrical side wall having a radius of curvature greater than the radius of the pad to be cleaned and a length greater than the length of the pad. The painting splatter shield side wall has an inner surface, an outer surface, front and back edges, and end edges. Parallel end walls are located at the ends of the side wall, and are preferably integrally formed with the side wall. Normally, the painting splatter shield side wall will extend around 180° or less of the pad when the pad is mounted.

The rinse splatter shield is also comprised of a semi-cylindrical side wall having a radius of curvature greater than the radius of the pad to be cleaned, but less than the radius of curvature of the painting splatter shield side wall, and a length greater than the length of the pad. The rinse splatter shield has an interior surface, an exterior surface, leading and trailing edges, and end edges. The rinse splatter shield also includes parallel end walls, with the rinse splatter shield side wall being shorter than the painting splatter shield side wall, so that the rinse splatter shield end walls fit inside the painting splatter shield end walls.

The rinse splatter shield is rotatable attached to the painting splatter shield and is rotatable between a closed position in which the rinse splatter shield side wall is substantially beneath the painting splatter shield side wall and a fully extended position in which the rinse splatter shield side wall is substantially exposed. When in the rinse position, the painting splatter shield and rinse splatter shield in combination will extend partially around the circumference of the paint pad, leaving a gap between the edges of the shields to permit discharge of water during rinsing. The terms closed position and stored position are used interchangeably throughout this specification with regard to the position of the rinse splatter shield when it is rotated such that the rinse splatter shield side wall is substantially beneath the painting splatter shield side wall.

Preferably, the rinse splatter shield also includes stops, e.g., cooperating notches and index tabs, to secure the rinse splatter shield relative to the painting splatter shield in the closed position during painting, and the fully extended position and intermediate positions during rinsing of the pad, creating a wider gap between the edges of the painting splatter shield and rinse splatter shield. For example, the rinse splatter shield can be rotated to the full extended position or to two partially extended positions for fast, medium and slow pad cleaning. A thumb tab may be provided on the rinse splatter shield to aid in manually moving the rinse splatter shield to the different positions.

In addition to the painting splatter and rinse splatter shields, the cover also includes a liquid manifold integral with the cover positioned to deliver a curtain of liquid to the paint roller to wash paint from the cylindrical pad after painting. The liquid manifold comprises a tubular section having a hollow interior, a closed lower end and an open upper end adapted for attachment to a hose. The tubular section includes a water outlet comprised of an elongated discharge opening or single slot in communication with the interior of the cover, whereby liquid is capable of flowing from the tubular section upper end through the hollow interior for discharge through the elongated discharge opening. In one embodiment, the water outlet comprised of the elongated discharge opening is segmented to form a plurality of spaced, longitudinally aligned holes in communication with the cover's interior. These holes are preferably covered by the rinse splatter shield when the rinse splatter shield is in the closed position, preventing paint from clogging the holes. A plug may be needed to plug the end of the liquid manifold depending on the injection molding process used to manufacture the shield.

The cover also includes means for supporting and mounting a paint pad with the longitudinal axis of the pad being coincident with the axis of curvature of the painting splatter and rinse splatter shields, and means for a user to hold the cover and pad during painting. In a first embodiment, the mounting means for the pad is a rotatable spindle that includes a handle extending substantially transverse to the axis of the spindle, with the spindle being mounted on the end walls of at least one of the shields for rotation within the shields. For example, the spindle handle adjacent one end of the spindle can be clipped to one end wall adjacent the spindle, while the opposite end of the spindle can be inserted into a rotatable end cap supported on the opposite end wall. In a second embodiment, roller pad end caps are attached to the ends of the pad for use in rotatably attaching the pad to the end walls of at least one of the shields, and a handle is attached to the outer surface of the painting splatter shield side wall.

More specifically, in a first embodiment, the cover is attached to a spindle or roller cage adapted to hold a rotatable cylindrical paint pad. The spindle includes a handle having an arm transverse to the spindle longitudinal axis, with a gripping section at the distal end of the arm. The spindle is rotatably supported on the end walls of the painting splatter and rinse splatter shields. For example, the distal end of the spindle, i.e., the end of the spindle opposite the handle grip, can be inserted into a bushing or other holder in one of the shield end walls, while the spindle at the intersection of the handle and spindle can be fitted into a slot in the painting splatter shield end wall and/or the rinse splatter shield end wall. An end cap can be fitted onto the distal end of the spindle to fit into the bushing or holder. The outer surface of the painting splatter shield end wall adjacent the handle end of the spindle can also include a clip to secure the spindle handle to the end wall. The clip may be in the form of a pair of spaced fins projecting outwardly from the end wall with the spacing between the fins being equal to or slightly greater than the diameter of the paint roller handle.

In a second embodiment, a detachable handle clips onto the outer surface of the painting splatter shield. The detachable cover handle is preferably hollow and includes an open proximal end to receive an extension pole for painting ceilings, etc. Some retailers of the present invention may consider the detachable handle as an after market option since the paint splatter and rinse splatter shield combination can be used with spindle and handle type paint roller frames. On the other hand, some purchasers of the paint roller tool of the present invention may prefer the detachable handle instead of a traditional spindle and handle type paint roller. In this case, the detachable handle would be sold along with the painting splatter and rinse splatter shields. In either case, the same mold could possibly be used to manufacture the painting splatter and rinse splatter shields. Therefore, the present invention offers manufacturing and marketing efficiencies.

A hose is also provided to attach the paint roller cover to a faucet or spigot. Generally, the hose will be a rubber or plastic hose having a fitting at one end adapted for attachment to a faucet or spigot, and the fitting at the other end being adapted for attachment to the paint roller cover. In a preferred embodiment, the fittings at both ends are female fittings. It will be understood, however, that one of the fittings may instead be male fittings, such as on a garden hose, or both may be male fittings, depending on the design of the tool attachment ends. Moreover, a plastic tube is provided to package the hose for sale and storage. The plastic tube has a cavity large enough to accommodate the hose in a folded configuration. The plastic tube may also hold a sheet of instructions on how to use the paint roller tool. Preferably, the plastic tube is transparent and is insertable within the paint roller tool in place of a paint roller pad. However, the paint roller tool can also be packaged with a useable paint roller pad.

Further still, the painting splatter shield includes a paint extraction tool that is releasibly attachable to the shield outer surface. The paint extraction tool has a handle and blade, wherein the blade has a semi-circular outer edge sized to receive a substantial arc-length of the circumference of the cylindrical paint pad. A clip or gripper tab extending outwardly from the painting splatter shield outer surface holds the paint extraction tool onto the painting splatter shield when the paint extraction tool is not in use.

The recommended first step in cleaning paint from a pad after painting is to remove the paint extractor tool from the clip on the outer surface of the painting splatter shield, and use it to scrape excess paint off the paint roller pad. Normally, the paint roller will be held with one hand to a position over a paint container while the other hand is used to scrape the blade of the paint extraction tool down the length of the paint roller pad, thereby scrapping excess paint off the pad and into the paint container. The roller pad can be rotated and scrapped until the desired amount of excess paint is removed. Then, the paint extractor tool is washed and returned to the gripper tab on the top of the painting splatter shield.

The quick clean-up roller cover is then prepared for washing by attaching one end of a hose to a faucet or spigot, and the other end of the hose to the upper end of the liquid manifold adapted for attachment to a hose. Next, the rinse splatter shield is readied for use by gripping the rinse splatter shield thumb tab with one hand while holding the painting splatter shield with the other and rotating the rinse splatter shield to one of its wash positions. The faucet or spigot is then turned on to wash the roller cover and pad. Water then enters the liquid manifold adjacent to the body of the cover. As water pressure builds within the liquid manifold, jets of water exit the plurality of holes in the liquid manifold tubular section creating a curtain of water that impacts generally tangentially against the roller pad causing the roller pad to spin, exposing all parts of the roller pad and interior of the painting splatter and rinse splatter shields to the curtain of water. The jets of water exit at an angle relative to the liquid manifold such that the various sized roller pads will spin when impacted. Centrifugal force resulting from the spinning, in conjunction with the force of the water curtain, forces the paint off of the roller pad and paint splatter shield. The rinse splatter shield contains the splatters resulting from the paint being forced off the paint roller by the curtain of water and centrifugal force. The liquid drainage gap between the back edge of the paint splatter shield and the leading edge of the rinse splatter shield allows the rinse solution to drain from the splatter shields and roller pad. Once the paint roller pad and roller are sufficiently clean of paint, the spigot or faucet is turned off, and the hose is removed from the liquid manifold. The rinse splatter shield is then rotated back to its stored position.

Other objectives of the invention will become apparent to one skilled in the art upon reading the following detailed description of the invention, taken with the drawings.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
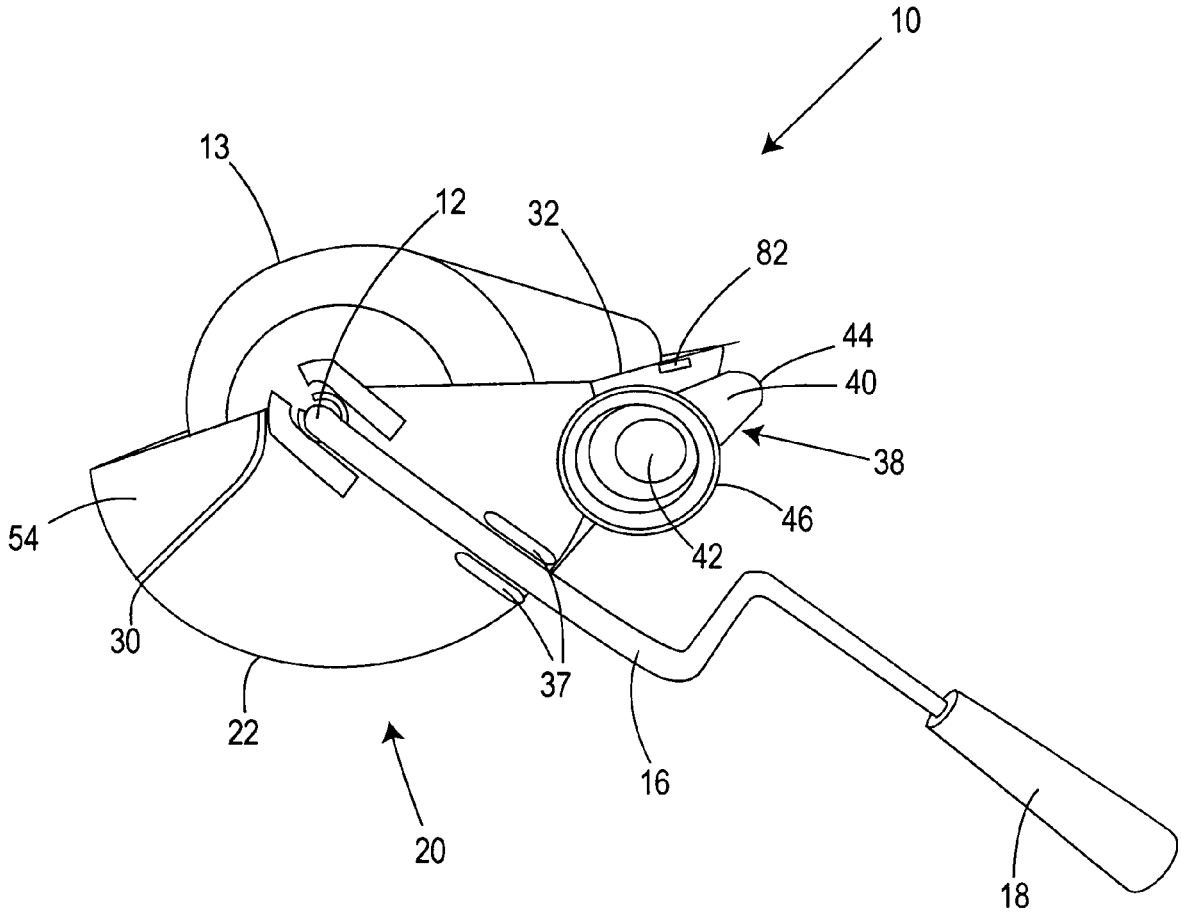
FIG. 1 is an end view of the quick-cleanup paint roller tool.
Figure 2:
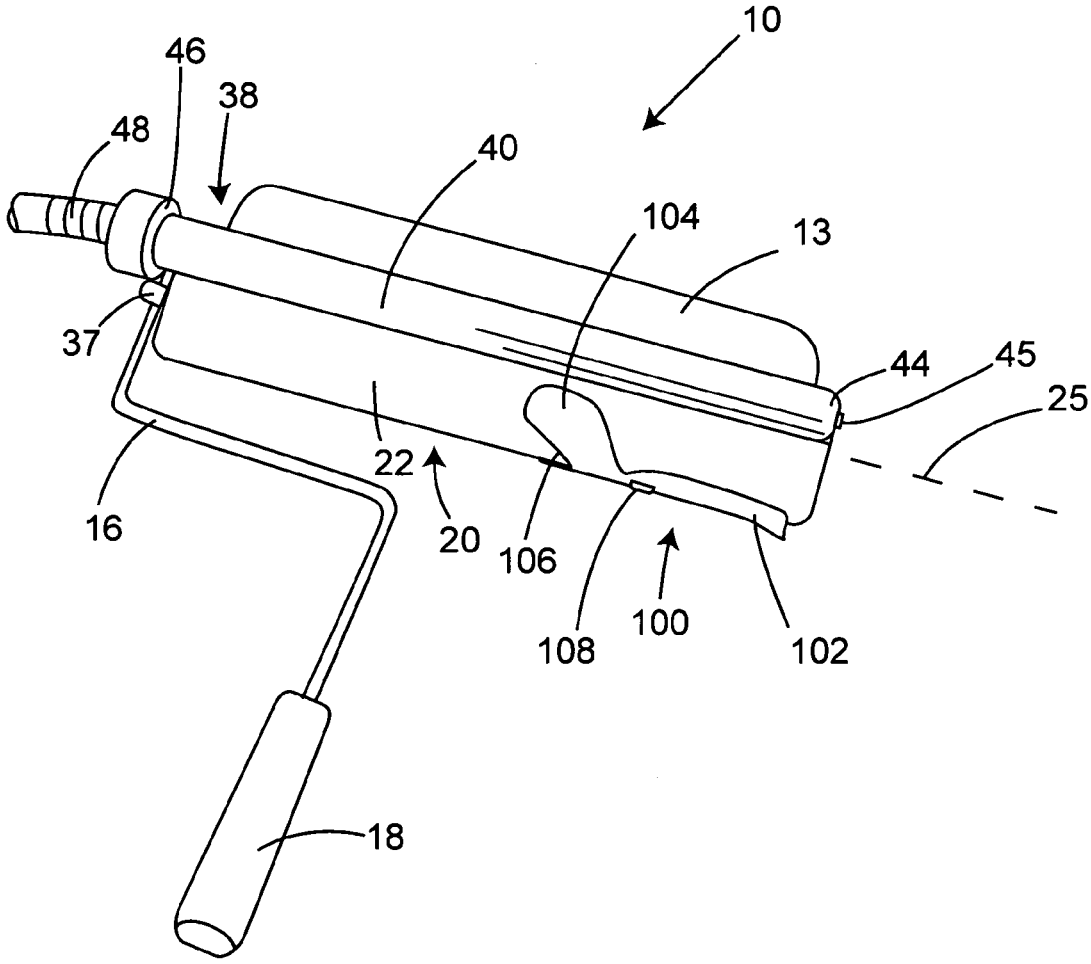
FIG. 2 is a side view of the quick-cleanup paint roller tool.
Figure 3:
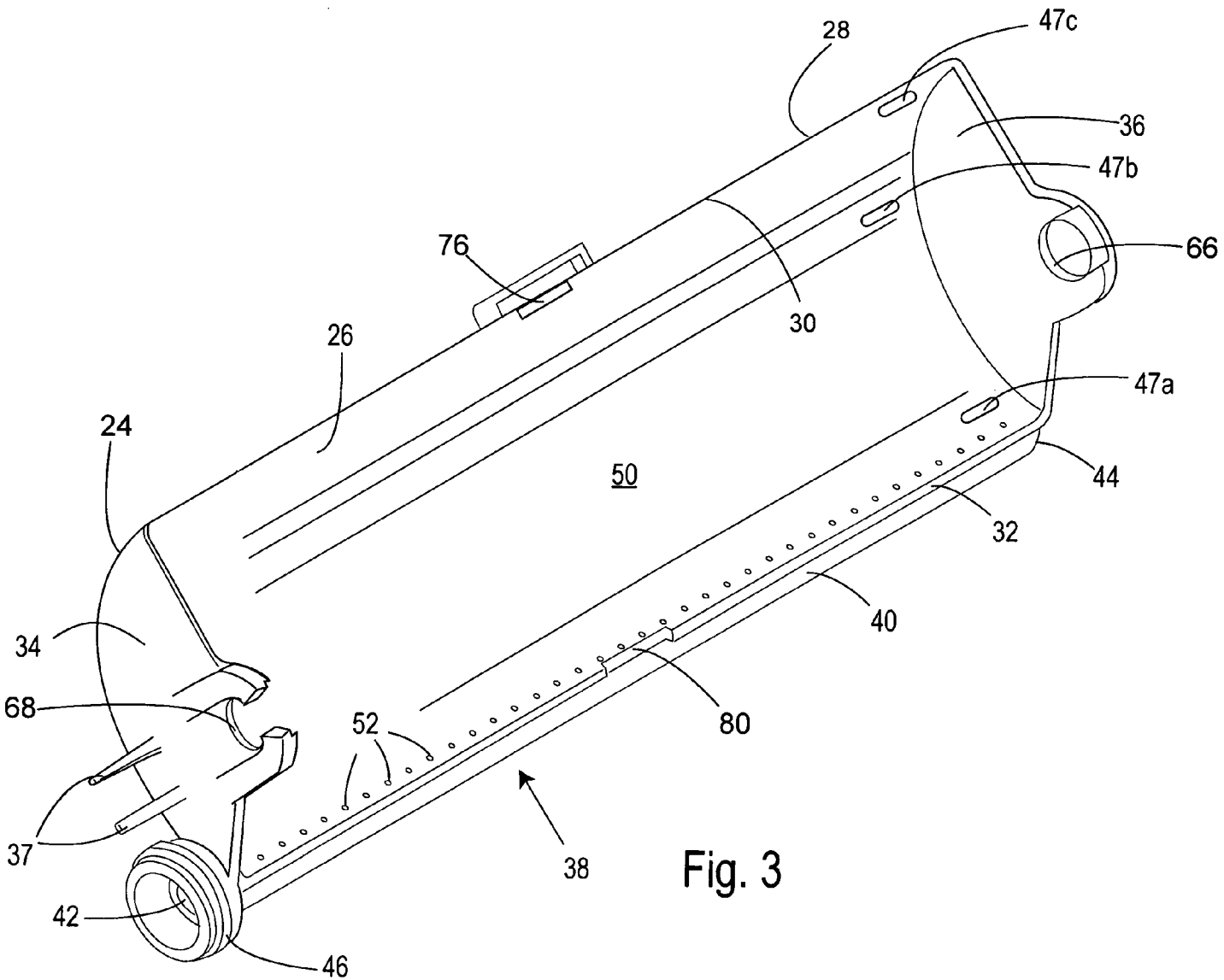
FIG. 3 is an interior view of the paint splatter shield.

FIGS. 1 and 2 illustrate one embodiment of the paint roller cover. A quick clean-up paint roller, generally 10, is comprised of a spindle 12 adapted to hold a rotatable cylindrical paint pad 13, and handle comprised of an arm 16 and grip 18. A paint roller cover 20 is attachable to paint roller 10, and is used to catch paint drips and splatter as roller 10 is used to apply paint to a wall, etc. Roller cover 20 has a painting splatter shield 22 with a semi-cylindrical side wall 24 having an axis of curvature about a central axis 25. As best seen in FIG. 3 side wall 24 has an inner surface 26, an outer surface 28, a front edge 30 and a back edge 32. Parallel end walls 34 and 36 are integral with the ends of side wall 24. One of end walls 34 or 36 includes a handle retainer clip in the form of fins 37 for holding paint roller arm 16 at a fixed angle.

A liquid manifold 38 is preferably integral with painting splatter shield 22 and is adjacent to painting splatter shield back edge 32. It is also preferred that manifold 38 is positioned to direct a curtain of liquid against roller pad 13, preferably tangentially, to wash roller pad 13 and cover 20 after painting. Liquid manifold 38 comprises a tubular section 40 having a length approximately equal to side wall 24, a hollow interior 42, a closed lower end 44, and an open upper end 46 adapted for attachment to a hose 48. Open upper end 46 is a water inlet that receives water from hose 48. FIG. 3 also shows a painting splatter shield interior 50, wherein tubular section 40 includes a water outlet comprising a plurality of spaced, longitudinally aligned holes 52 in communication with shield interior 50, whereby liquid is capable of flowing from tubular section upper 46 through hollow interior 42 for discharge through holes 52. A plurality of index notches 47*a*, 47*b*, and 47*c* located in painting splatter shield inner surface 26 correspond to wash positions. The fast cleaning position corresponds to index notch position 47*a*, while medium and slow wash positions correspond to index notches 47*b* and 47*c*.

The integral structure of painting splatter shield 22 lends itself to efficient and cost effective injection molding manufacturing. An injection-molding plug 45 is used to plug an injection hole left in end 44 as a result of an injection molding process during manufacture.

Figure 4:
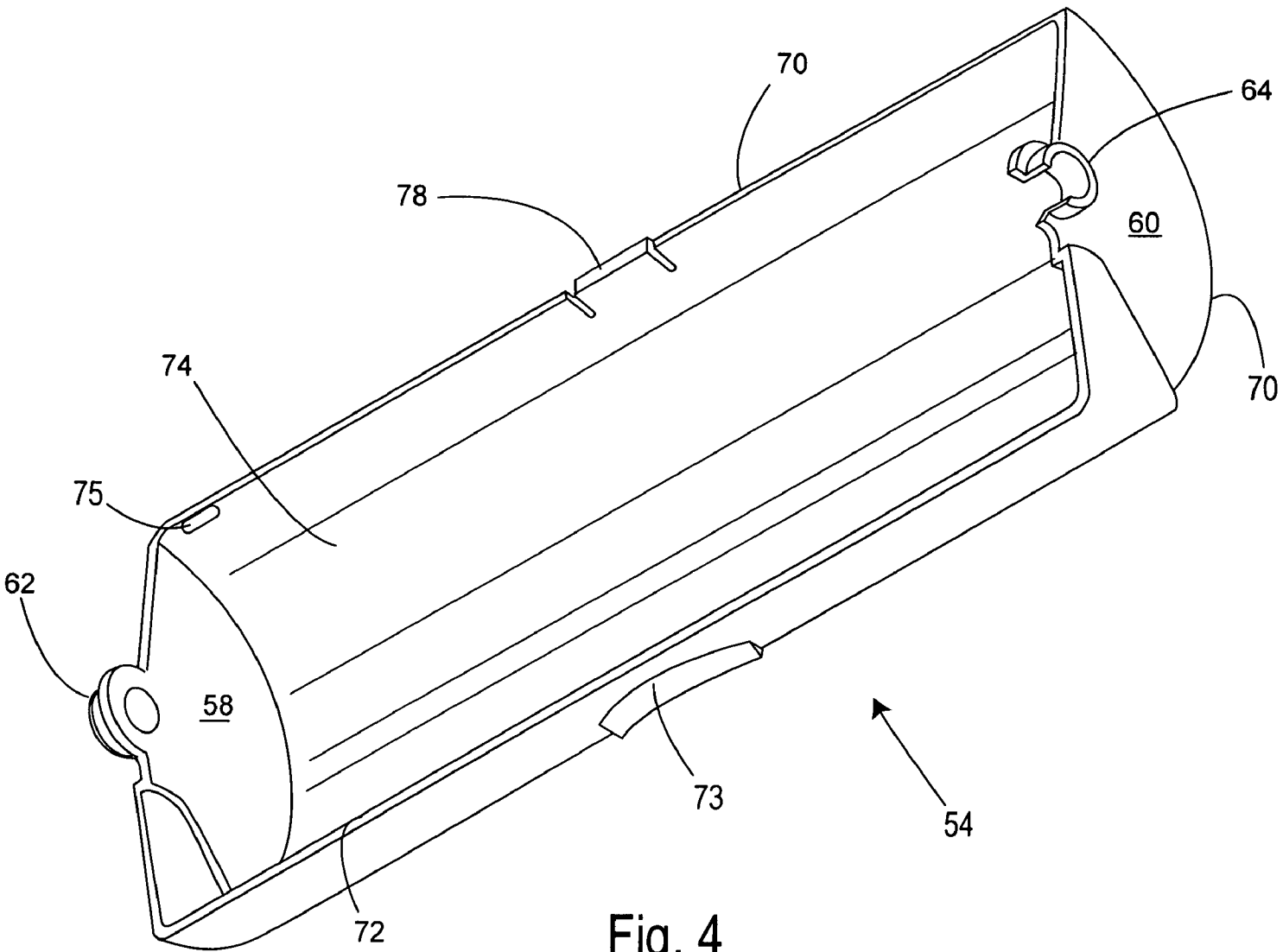
FIG. 4 is an interior view of the rinse splatter shield.

FIG. 4 illustrates rinse splatter shield 54, which is rotatably mountable within the painting splatter shield 22. Rinse splatter shield 54 includes a semi-cylindrical side wall 56 having an axis of curvature about a central axis 25. The radius of curvature of side wall 56 is less than that of side wall 24 so that side wall 56 is rotatable beneath side wall 24. Preferably, the radius of curvature of the inner surface of side wall 24 is approximately equal to the radius of curvature of the outer surface of side wall 56. Rinse splatter shield 54 also includes end walls 58 and 60.

Bushings 62 and 64 on end walls 58 and 60, respectively, are rotatably mountable in bushing receivers 66 and 68 of FIG. 3. Bushing 68 is adapted to engage the end of handle 16 adjacent spindle 12. Bushing 68 includes a side opening or V groove through which the beginning of handle 16 can be removed or inserted in order to change roller pads. In other embodiments, either or both bushings could include a side opening or both bushings could exclude a side opening.

Rinse splatter shield 54 has a leading edge 70 and a trailing edge 72 as well as an interior surface 74 and an exterior surface 74*a*. A stop tab 78 is located along leading edge 70. Referring back to FIG. 3, a first lock notch 80 is located on painting splatter shield front edge 32. A second lock notch 76 is engaged by stop tab 78 of FIG. 4 while the rinse splatter shield is in its rinse position. The first lock notch 80 is located along painting splatter shield front edge 32 and is engaged by rinse splatter shield stop tab 78 whenever rinse splatter shield 54 is in its stored position. A thumb tab 73 is located on the exterior surface of rinse splatter shield 54 near its trailing edge 72. Thumb tab 73 helps a user grip rinse splatter shield 54 while moving rinse splatter shield 54 from one of its positions to another. A latching means in the form of a stop tab 75 is lockable with index notches 47*a*, 47*b* and 47*c*, corresponding to the fast, medium and slow washing positions, respectively.

Figure 5:
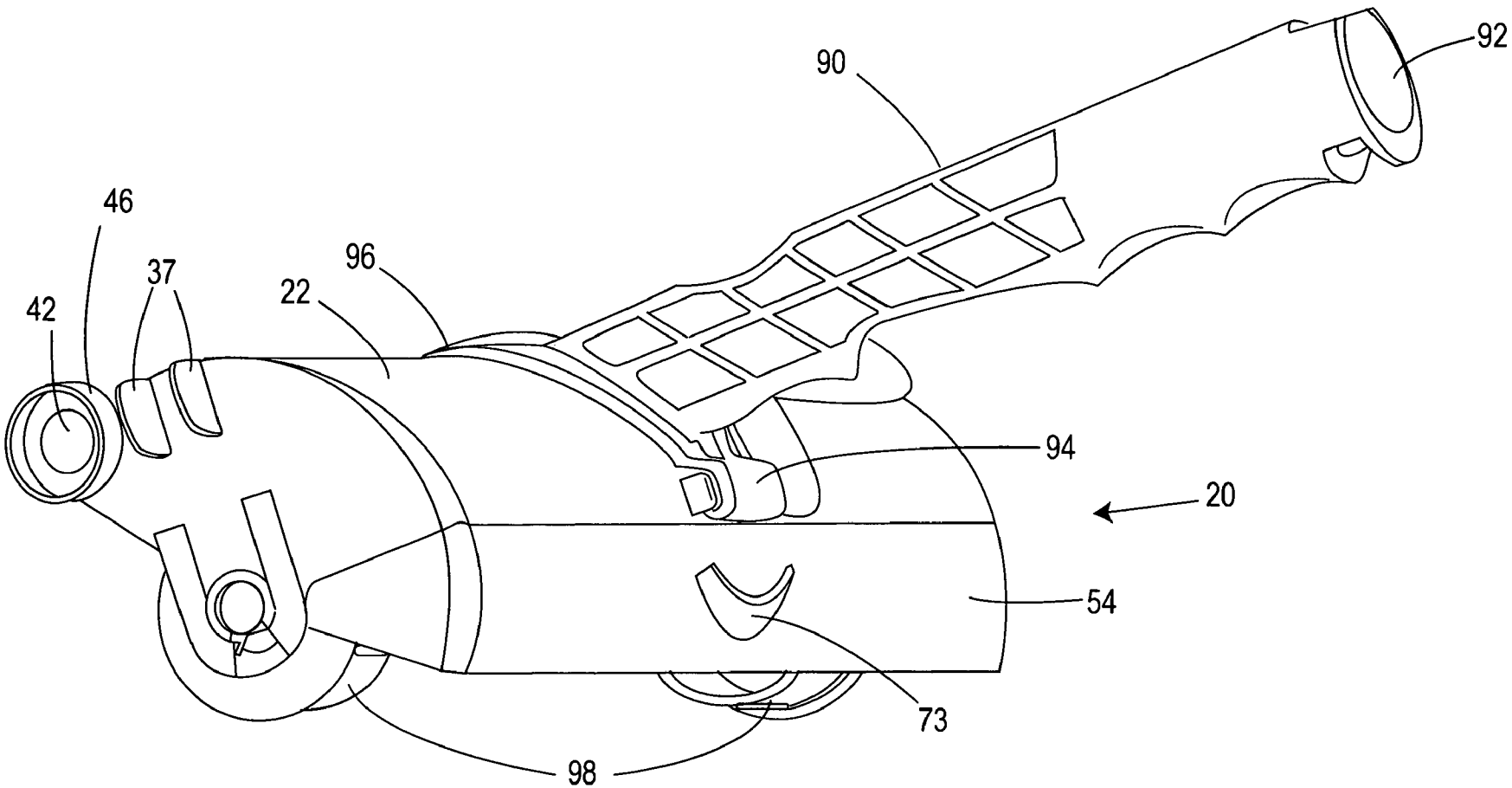
FIG. 5 is a perspective view of the paint roller tool with a detachable handle.

FIG. 5 shows a perspective view paint cover 20 along with a cover handle 90 that is attachable to the middle of painting splatter shield 22. Handle 90 has a hollow proximal end 92 for receiving the end of an extension pole (not shown). Handle 90 also includes a rearward brace 94 that follows the curvature of cover 20, and ends as a fold around cover back edge 30, and a forward brace 96 that follows the curvature of cover 20 ending as a partial wrap around a substantial portion of the circumference of tube 40 of liquid manifold 38. Since detachable cover handle 90 is located in the middle of cover 20 both right and left-handed users can use it. Therefore, it is possible to manufacture the handle cover combination shown in FIG. 5 in a one step injection molding process, which brings down the cost to a sellable price. A pair of roller pad end caps 98 are used to rotatably mount a roller pad to painting splatter shield 22 since an arm and spindle type roller is not used when detachable handle 90 is attached to painting splatter shield 22.

Figure 6:
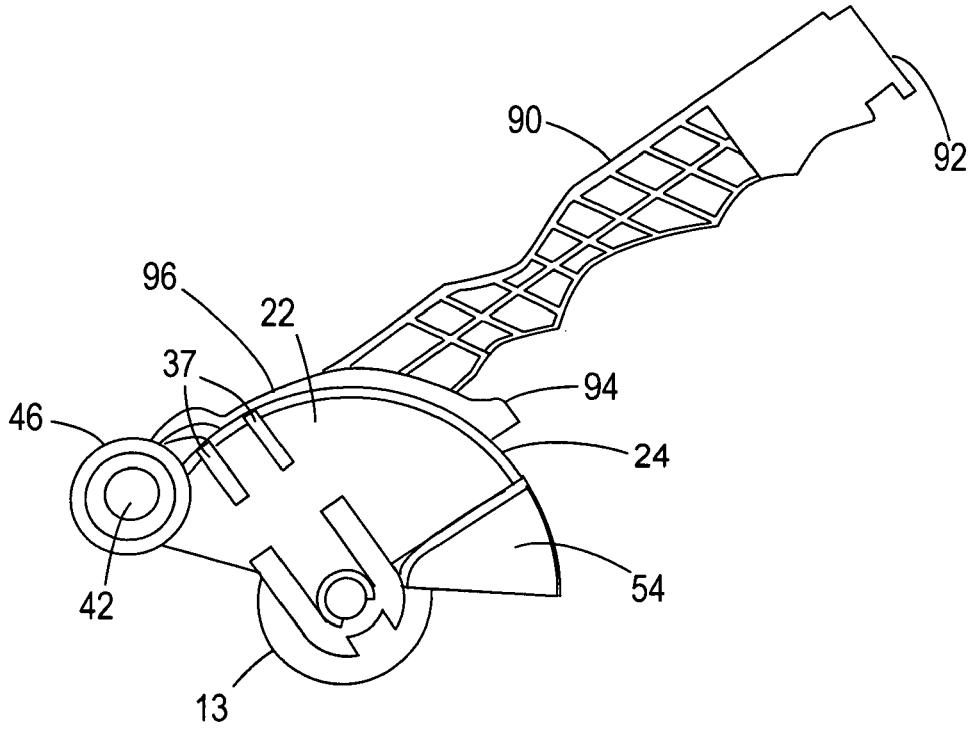
FIG. 6 is an end view of the paint roller tool with the rinse splatter shield in its stored position.

FIG. 6 shows a side view of paint cover 20 and attached handle 90 wherein rinse splatter shield 54 is in its stored position. In its stored position during painting, most of rinse splatter shield 54 is beneath painting splatter shield 22.

Figure 7:
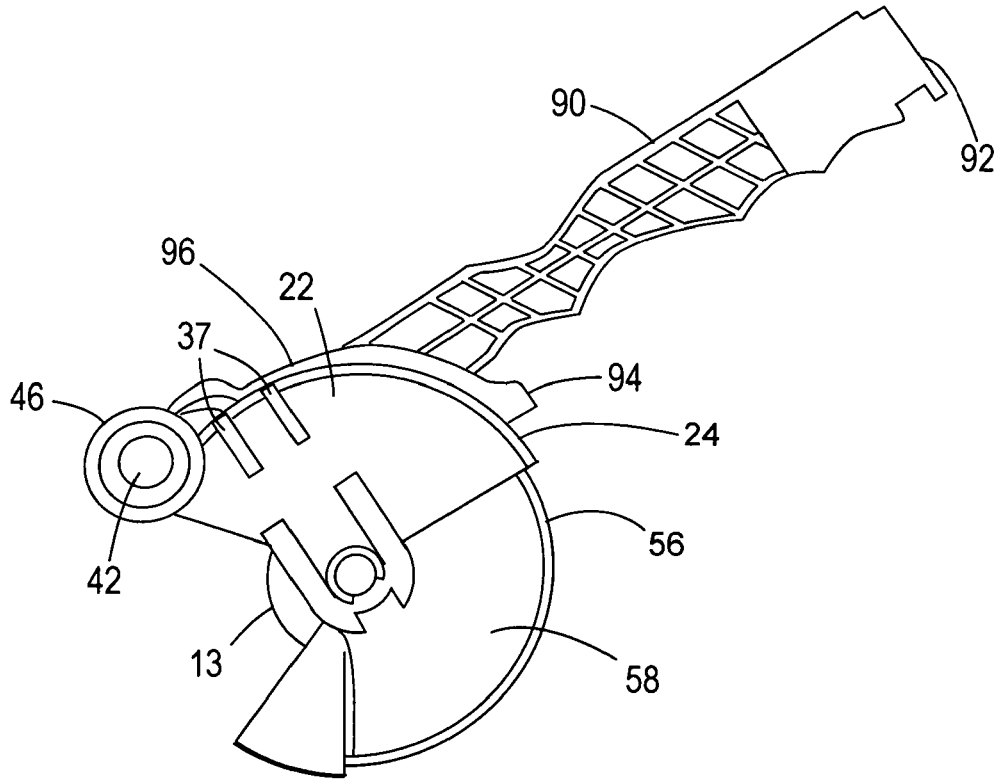
FIG. 7 is an end view of the paint roller tool with the rinse splatter shield in its rinse position.
Figure 8:
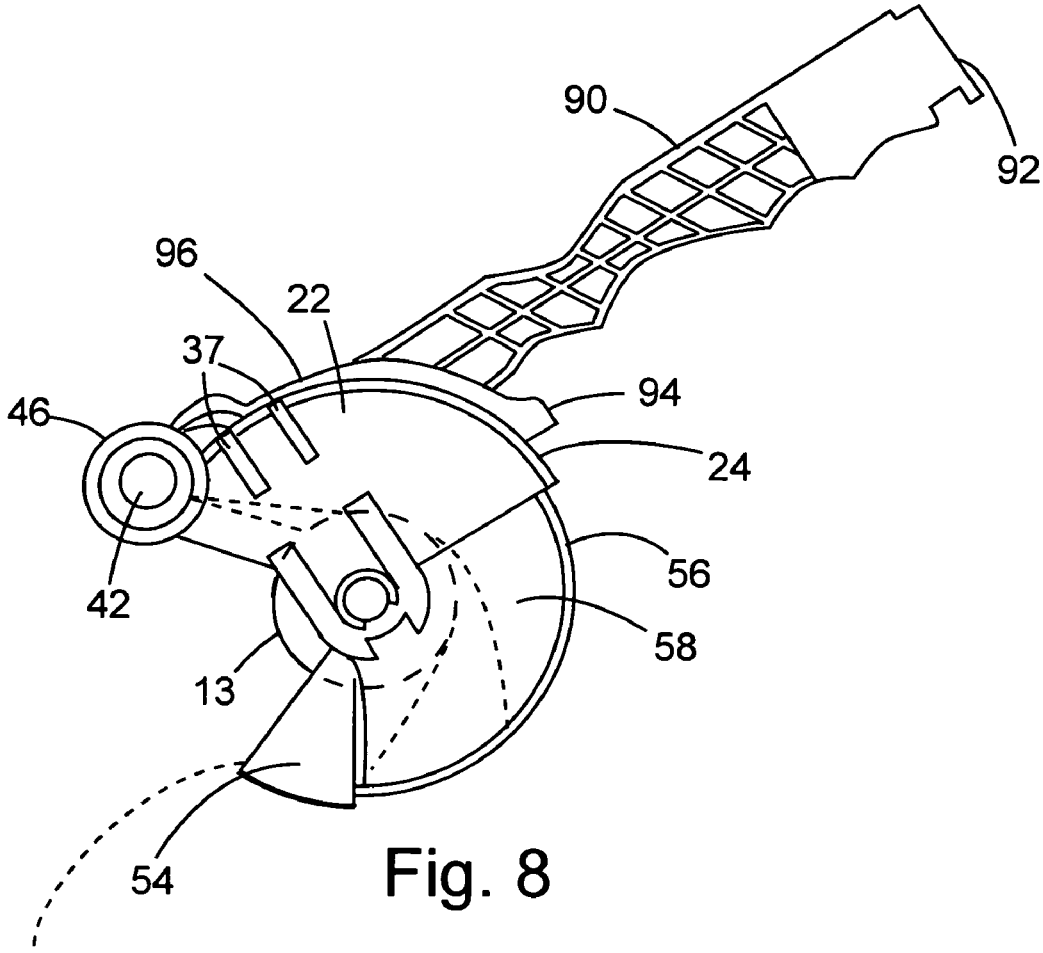
FIG. 8 depicts jets of water (represented by thin dashed lines) tangentially impacting the rotatable cylindrical paint pad thereby urging it to rotate.

FIG. 7 shows a side view of paint cover 20 and attached handle 90 wherein rinse splatter shield 54 is in its rinse position. In its rinse position most of rinse splatter shield 54 extends outside painting splatter shield 22. The rinse splatter shield rinse position is used whenever roller pad 13 needs to be substantially, but not completely, enclosed to prevent a rinse solution of diluted paint from slinging or splattering while a curtain of liquid is directed against paint roller pad 13.

Referring back to FIG. 2, painting splatter shield 22 also includes a paint extraction tool 100 for removing excess paint from roller pad 13 before washing. Paint extraction tool has a handle 102 and a blade 104, wherein blade 104 has a semi-circular edge 106, sized to receive a substantial arc-length of the circumference of roller pad 13. When attached to painting splatter shield 22, a gripping tab 108 that projects outwardly from painting splatter shield 22 holds paint extractor tool 100.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. An apparatus for covering and cleaning a paint roller pad having a cylindrical side wall, a given length, and a central longitudinal axis, said apparatus comprising:

a) a painting splatter shield having a semi-cylindrical side wall with an axis of curvature and parallel end walls;

b) mounting means for rotatably mounting said pad so that the said painting splatter shield side wall is spaced from a first segment of said pad side wall with the longitudinal axis of the pad is coincident with the axis of curvature of said painting splatter shield side wall;

c) a rinse splatter shield having a semi-cylindrical side wall and parallel end walls, said rinse shield being rotatable between a closed position substantially beneath said painting splatter shield side wall and an extended position spaced from a second segment of said roller outer surface, said first and second segment having leading edges spaced from each other to form a water discharge gap when said rinse splatter shield is in its extended position; and d) a water manifold having a water inlet and a water outlet, said outlet directing water to contact a roller rotatably supported within said shields; and wherein said water outlet is covered by said rinse shield when said rinse splatter shield is in the closed position.

2. The apparatus of claim 1, wherein said mounting means is carried by the end walls of at least one of said shields.

3. The apparatus of claim 1, further including roller pad end caps attachable to the ends of said paint roller and rotatably mountable on said end walls.

4. The apparatus of claim 1, further including a handle attached to said painting splatter shield.

5. The apparatus of claim 1, wherein said water outlet is comprised of a plurality of longitudinally aligned holes parallel to said central axis and angled to direct water tangentially against a roller supported within said shields.

6. The apparatus of claim 1, further including a paint scraper detachably mounted on said painting splatter shield.

7. The apparatus of claim 1, wherein said rinse splatter shield has at least one intermediate position between said closed position and said extended position, and latching means to releasibly secure said rinse splatter shield at each of said positions.

8. An apparatus for covering and cleaning a cylindrical paint roller pad mounted on a rotatable spindle having a longitudinal axis and a handle substantially transverse to said longitudinal axis, said apparatus comprising:

a) a painting splatter shield having a semi-cylindrical side wall with an axis of curvature and parallel end walls;

b) mounting means for rotatably mounting said spindle so that the said painting shield side wall is spaced from a first segment of said pad side wall with the longitudinal axis of the pad is coincident with the axis of curvature of said painting splatter shield side wall;

c) a rinse shield having a semi-cylindrical side wall and parallel end walls, said rinse splatter shield being rotatable between a closed position substantially beneath said painting splatter shield side wall and an extended position spaced from a second segment of said roller outer surface, said first and second segment having leading edges spaced from each other to form a water discharge gap when said rinse splatter shield is in its extended position; and d) a water manifold having a water inlet and a water outlet, said outlet directing water to contact a roller rotatably supported within said shields and wherein said water outlet is covered by said rinse splatter shield when said rinse splatter shield is in the closed position.

9. The apparatus of claim 8, wherein one of said painting splatter shield end walls includes a handle retainer to secure said spindle handle relative to said end wall.

10. The apparatus of claim 8, wherein said spindle handle is insertable into a slot in one of said end walls.

11. The apparatus of claim 8, wherein said water outlet is comprised of a plurality of longitudinally aligned holes parallel to said central axis and angled to direct water tangentially against a roller supported on the end walls of one of said shields.

12. The apparatus of claim 8, further including a paint extraction tool detachably mounted on said painting splatter shield.

13. An apparatus for covering and cleaning a paint roller pad having a cylindrical side wall, a given length, and a central longitudinal axis, said apparatus comprising:

a) a painting splatter shield having a semi-cylindrical side wall with an axis of curvature and parallel end walls;

b) mounting means for rotatably mounting said pad so that the said painting shield side wall is spaced from a first segment of said pad side wall with the longitudinal axis of the pad is coincident with the axis of curvature of said painting shield side wall;

c) a rinse splatter shield having a semi-cylindrical side wall and parallel end walls, said rinse shield being rotatable between a closed position substantially beneath said painting splatter shield side wall and an extended position spaced from a second segment of said roller outer surface, said first and second segment having leading edges spaced from each other to form a water discharge gap when said rinse splatter shield is in its extended position;

d) a water manifold having a water inlet and a water outlet, said water manifold comprising an injection moldable tubular section integral with said painting splatter shield and parallel with said central longitudinal axis, wherein said tubular section has a hollow interior, a closed lower end and an open upper end adapted for attachment to a hose at said water inlet, said outlet directing water to contact a roller rotatably supported within said shields; and e) a handle attached to said painting splatter shield side wall; and wherein said water outlet is covered by said rinse splatter shield when said rinse splatter shield is in the closed position.

14. The apparatus of claim 13, wherein said handle includes forward and rearward braces.

15. The apparatus of claim 13, further including roller pad end caps attachable to the ends of said paint roller and rotatably mountable to the end walls of at least one of said shields.

16. The apparatus of claim 13, wherein said water outlet is comprised of a plurality of longitudinally aligned holes parallel to said central axis and angled to direct water tangentially against a roller supported on the end walls of one of said shields.

17. The apparatus of claim 13, further including a paint extraction tool detachably mounted on said painting splatter shield.

* * * * *